US012667774B1

(12) United States Patent
Elwin et al.

(10) Patent No.: US 12,667,774 B1
(45) Date of Patent: Jun. 30, 2026

(54) COLLAPSIBLE RAMP FOR AN AMUSEMENT GAME DEVICE

(71) Applicant: Stern Pinball, Inc., Elk Grove Village, IL (US)

(72) Inventors: Keith Elwin, Elk Grove Village, IL (US); J. Harrison Drake, Jr., Elk Grove Village, IL (US); Richard J. Naegele, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 516 days.

(21) Appl. No.: 18/330,931

(22) Filed: Jun. 7, 2023

Related U.S. Application Data

(60) Provisional application No. 63/349,877, filed on Jun. 7, 2022.

(51) Int. Cl.
*A63F 7/30* (2006.01)
*A63F 7/02* (2006.01)

(52) U.S. Cl.
CPC ..... *A63F 7/30* (2013.01); *A63F 7/027* (2013.01); *A63F 2007/303* (2013.01)

(58) Field of Classification Search
CPC ..... A63F 7/30; A63F 7/027; A63F 2007/303; A63F 7/36; A63F 7/28; A63H 18/02; A63H 18/028
See application file for complete search history.

(56) References Cited

U.S. PATENT DOCUMENTS 4,981,298 A * 1/1991 Lawlor ..... A63F 7/3075 273/121 A
5,226,653 A 7/1993 Bil
5,338,031 A 8/1994 Patla, Sr. et al.
5,356,142 A * 10/1994 Borg ..... A63F 7/027 273/121 A
5,358,240 A * 10/1994 Lawlor ..... A63F 7/3065 273/127 R
5,383,663 A * 1/1995 Anghelo ..... A63F 7/027 273/121 A
5,494,285 A * 2/1996 Coldebella ..... A63F 7/22 273/118 R
5,938,195 A * 8/1999 Anghelo ..... A63F 7/027 273/127 R
6,158,737 A 12/2000 Cornell et al.
2007/0026918 A1 2/2007 Sheats

OTHER PUBLICATIONS

Non-final Office Action from U.S. Appl. No. 18/330,839, dated Mar. 27, 2026, 9 pp.

* cited by examiner

*Primary Examiner* — Michael D Dennis
(74) *Attorney, Agent, or Firm* — Greenberg Traurig, LLP

(57) ABSTRACT

A collapsible ramp assembly for use with a pinball machine having a playfield and a ball which moves across a surface of the playfield. The collapsible ramp assembly includes a base mountable to the surface of the playfield, a first ramp portion pivotally coupled to the base and including a first ramp surface, a second ramp portion pivotally coupled to the base and comprising a second ramp surface, a slidable shaft pivotally couplable to the first ramp portion and having a longitudinal axis extending through the playfield and being movable between a first position and a second position along the longitudinal axis, a rigid link pivotally coupled to both the first ramp portion and the second ramp portion, and an actuator coupled to the slidable shaft to move the slidable shaft between the first position and the second position.

20 Claims, 11 Drawing Sheets

COLLAPSIBLE RAMP FOR AN AMUSEMENT GAME DEVICE

CROSS REFERENCE TO RELATED APPLICATION

This application is a non-provisional application claiming priority from U.S. Provisional Application Ser. No. 63/349,877, filed Jun. 7, 2022, and incorporated herein by reference in its entirety.

FIELD OF THE DISCLOSURE

The present description relates generally to an amusement device, such as a pinball machine, and more particularly an amusement device with a collapsible ramp.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

While the above-referenced patents and applications may be suitable for their intended purposes, there is an identifiable need for improvement thereto.

BRIEF DESCRIPTION OF THE DRAWINGS

For a better understanding of the collapsible ramp disclosed hereinafter reference may be had to the following drawings.

DETAILED DESCRIPTION

The following description of example methods and apparatus is not intended to limit the scope of the description to the precise form or forms detailed herein. Instead, the following description is intended to be illustrative so that others may follow its teachings.

Referring now to the figures, an example amusement device, such as a pinball machine having a playfield layout, is illustrated. In this example, the pinball machine includes a collapsible ramp.

With reference to the figures, an amusement game device, in the example form of a pinball machine 10 is now described. It is to be appreciated, however, that this example form for the amusement game device is not intended to be limiting. Rather, those of ordinary skill in the art will appreciated that the example collapsible ramp disclosed hereinafter can be utilized in any type of amusement game device of the commercial and non-commercial type in which it is desired to operate a mechanism as disclosed.

Figure 1:
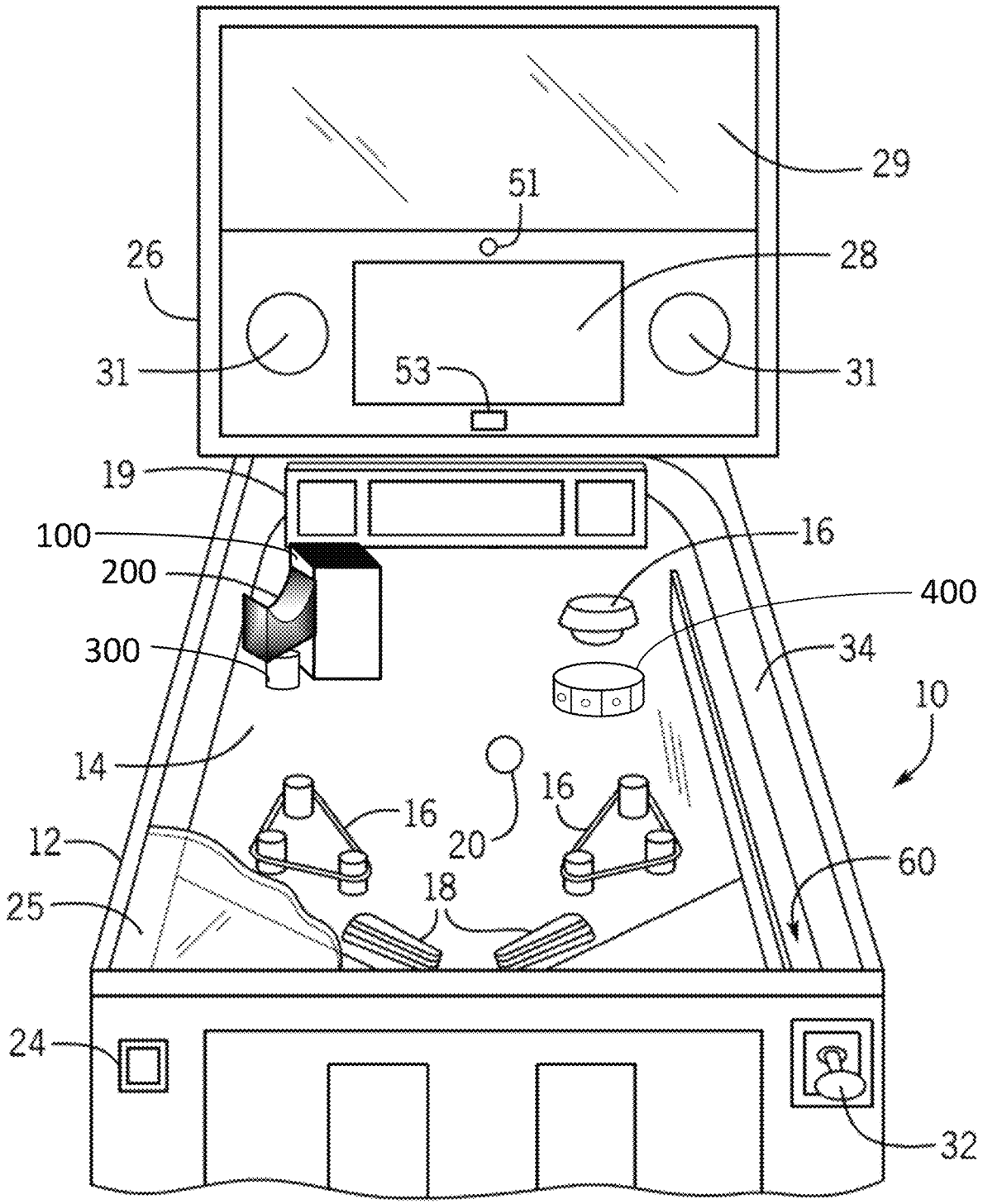
FIG. 1 illustrates an example amusement game device in the form of a pinball machine including an example of the disclosed collapsible ramp.

The example pinball machine 10 illustrated in FIG. 1 includes a cabinet 12 which houses various apparatus used to define play of a game (e.g., "gameplay"). Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a QR code reading device, a near field communications device, etc., and/or by otherwise making gameplay active, including free play. Upon activation of the game in this manner, gameplay, in the case of the example pinball machine 10, is defined upon an inclined playfield 14 that supports a number of playfield elements, accessories, and/or devices.

More particularly, in the case of the example pinball machine 10, gameplay is generally defined through the use of a pair of pivotable, flippers 18 to propel a game ball such as ball 20 for movement relative to an upper side (e.g., a top surface) of the playfield 14 and input devices/accessories associated with the playfield 14. In this example the playfield 14 also includes a backpanel 19 located near an upper portion of the playfield 14 away (e.g. distally located) from the player and the flippers 18. In this example, the backpanel 19 stands upright (e.g., vertical) from the playfield 14. While generally described as being horizontal, the playfield 14 is usually inclined from the horizontal, such as for instance between approximately 6.5 to 7.0 degrees, such that the ball tends to eventually roll back down the playfield 14 in the direction of the flippers 18. While not intended to be limiting, the playfield accessories or input devices may include elements such as bumpers 16, targets (e.g. drop bank targets, spinner targets, etc.) which will be described in greater detail hereinafter. With the present disclosure, the targets, ramps, ball pathways, etc., may include a tiered structure 100, a bridge, such as a collapsible ramp 200, an electromagnet newton ball and ball diverter assembly 300, and a rotating target assembly 400. These specific components may include specialized functionality (see FIG. 4 et seq.) as will be described.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the flippers 18 or otherwise interacting with gameplay. The pinball machine 10 may also include a backbox 26 which is mounted to overlay a top rear portion of the cabinet 12 and which in this example contains artwork 29, and a display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including the speakers 31 and any additional sound system components. Such electronic devices/circuits could also, in whole or in part, be carried within the cabinet 12, or may be external to the game cabinet and linked to the pinball machine 10 via any suitable wired or wireless configuration.

Figure 2:
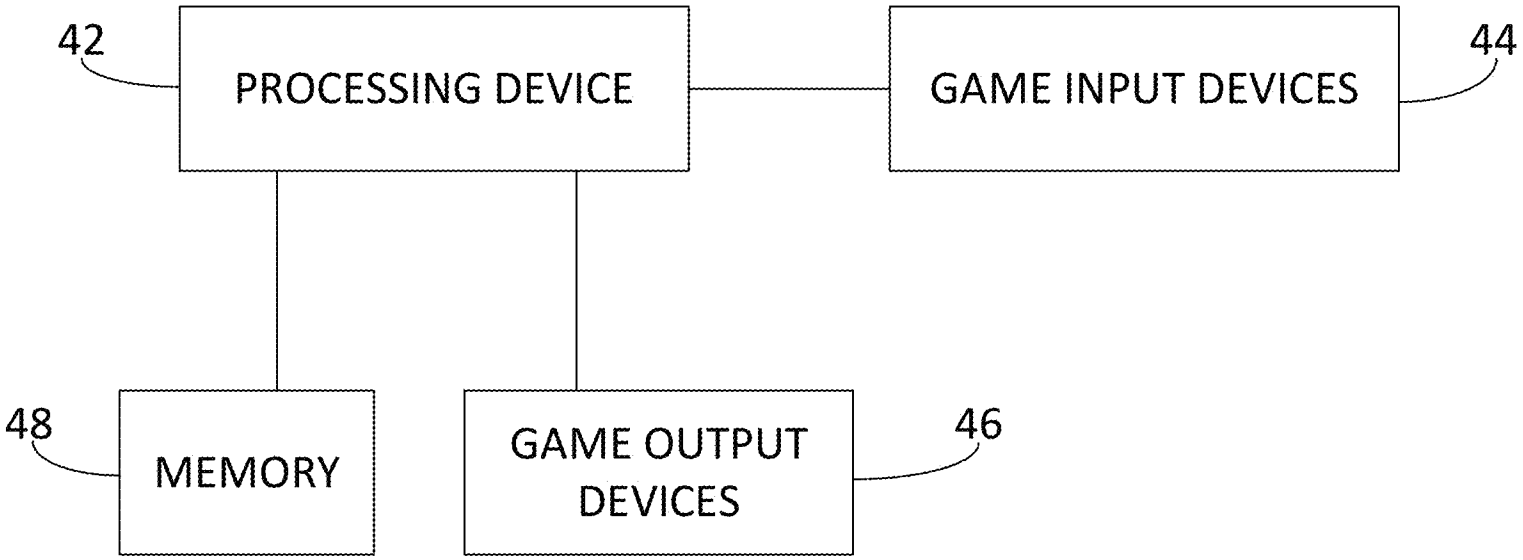
FIG. 2 is an example block diagram of example components of the amusement game device of FIG. 1.

Referring to FIG. 2, for controlling the various devices that form the amusement game, the example pinball machine 10 is provided with a processing device 42 which processing device 42 is, in turn, coupled to game input devices 44, such as switches associated with the cabinet 12 or the playfield 14, and game output devices 46, such as lights (including lights associated with the playfield), the bumpers 16, the flippers 18, the targets, the display 28, the tiered structure 100, the collapsible ramp 200, the electromagnet newton ball and ball diverter assembly 300, the rotating target assembly 400, etc. via one or more bus systems. A memory device 48, such as a RAM, ROM, or the like, stores instructions and data usable by the processing device 42 to control gameplay, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3:
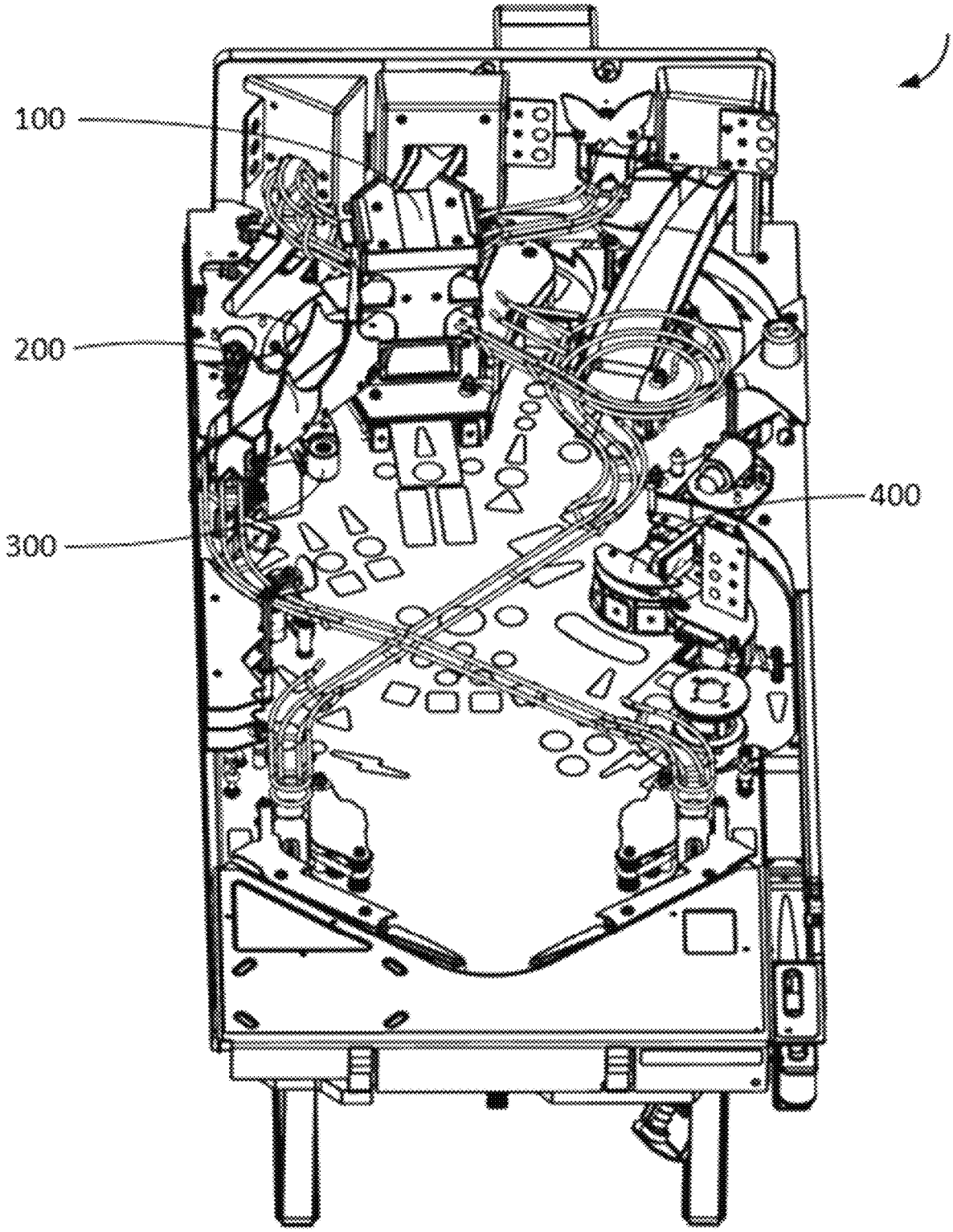
FIG. 3 is a perspective view of an example pinball playfield, including a plurality of gameplay features as disclosed herein.

As also illustrated in FIG. 3, more precisely, the example pinball machine 10 includes the tiered structure 100, which is configured to move in a direction perpendicular to a plane defined by the playfield 14 to provide access for the ball 20 to each of the various tiers that form the tiered structure 100. The tiered structure 100 is described in greater depth in the patent application filed concurrently herewith as U.S. application Ser. No. 18/330,839, the contents of which are incorporated herein in their entirety and for all purposes.

The example pinball machine 10 also includes the collapsible ramp 200, which is formed by two separate components configured to rotate independently of one another. In response to a single mechanical input, the separate components rotate and simulate a collapse of the collapsible ramp 200, such that one of the separate components functions as a ramp rather than as gap-traversing path. The collapsible ramp 200 is described in greater depth below.

The example pinball machine 10 also includes the electromagnet newton ball and ball diverter assembly 300, which is configured to provide an electromagnetic newton ball diverter. The electromagnet newton ball and ball diverter assembly 300 is described in greater depth in the patent application filed concurrently herewith as U.S. application Ser. No. 18/330,870, the contents of which are incorporated herein in their entirety and for all purposes.

The example pinball machine 10 also includes the rotating target assembly 400, which is configured to provide a selectable, rotatable target and ramp combination. The rotating target assembly 400 is described in greater depth in the patent application filed concurrently herewith as U.S. application Ser. No. 18/330,915, the contents of which are incorporated herein in their entirety and for all purposes.

Turning now to FIGS. 4-9, an example collapsible ramp 200 for use in connection with a playfield 14 is described. Generally, the collapsible ramp 200 includes a base 210, a first ramp portion 220, a second ramp portion 230, a slidable shaft 240, a rigid link 250, and an actuator (not shown).

The base 210 is mountable to the surface of the playfield 14 through a mount 211. The mount 211 defines an opening 213 through which the slidable shaft 240 is received and a mount surface 212 which extends in a perpendicular direction relative to the slidable shaft 240. The mount 211 may be mounted to the surface of the playfield 14 through any suitable fastener such as threaded bolt which is secured to the playfield 14, in this instance the upper side of the playfield 14, by a washer and nut (not shown). The mount 211 may be any suitable material for securely mounting the base 210 to the playfield 14, such as stainless steel, plastic, metal, etc.

The first ramp portion 220 includes a first ramp surface 221 which is supported in an elevated arrangement above the playfield 14. The first ramp portion 220 is pivotably coupled to the slidable shaft 240 at a first pivot 262 which is rotatable about a first pivot axis 262*a*. The first ramp portion 220 is pivotably coupled to the base 210 at a second pivot 264 and the first ramp portion 220 is rotatable about a second pivot axis 264*a* relative to base 210. The first ramp portion 220 is also pivotably coupled to the rigid link 250 at a third pivot 265. The first pivot axis 262*a* and the second pivot axis 264*a* may be offset and parallel, as shown in FIGS. 4-8. When the slidable shaft 240 moves between a first position (FIG. 5) and a second position (FIG. 6), the slidable shaft 240 causes the first ramp portion 220 to move relative to the mount about the second pivot axis 264*a*.

The second ramp portion 230, which is mounted adjacent to the first ramp portion 220, includes a second ramp surface 231 which is supported in an elevated arrangement above the playfield 14. The second ramp portion 230 is pivotably coupled to the rigid link 250 at a fourth pivot 266. The second ramp portion 230 is also pivotably coupled to the base 210 at a fifth pivot 268 and the second ramp portion 230 is rotatable about a fifth pivot axis 268*a* relative to base 210. As previous described, when the slidable shaft 240 moves between the first position (FIG. 5) and the second position (FIG. 6), movement of the slidable shaft 240 along a longitudinal axis 240*a* causes the first ramp portion 220 to move about the second pivot axis 264*a*. This causes the rigid link 250 to move about the second pivot 264 and move in a perpendicular direction relative to the slidable shaft 240, such that the rigid link 250 also pivots about the fourth pivot 266. This causes the second ramp portion 230 to move about the fifth pivot axis 268*a*.

Figure 4:
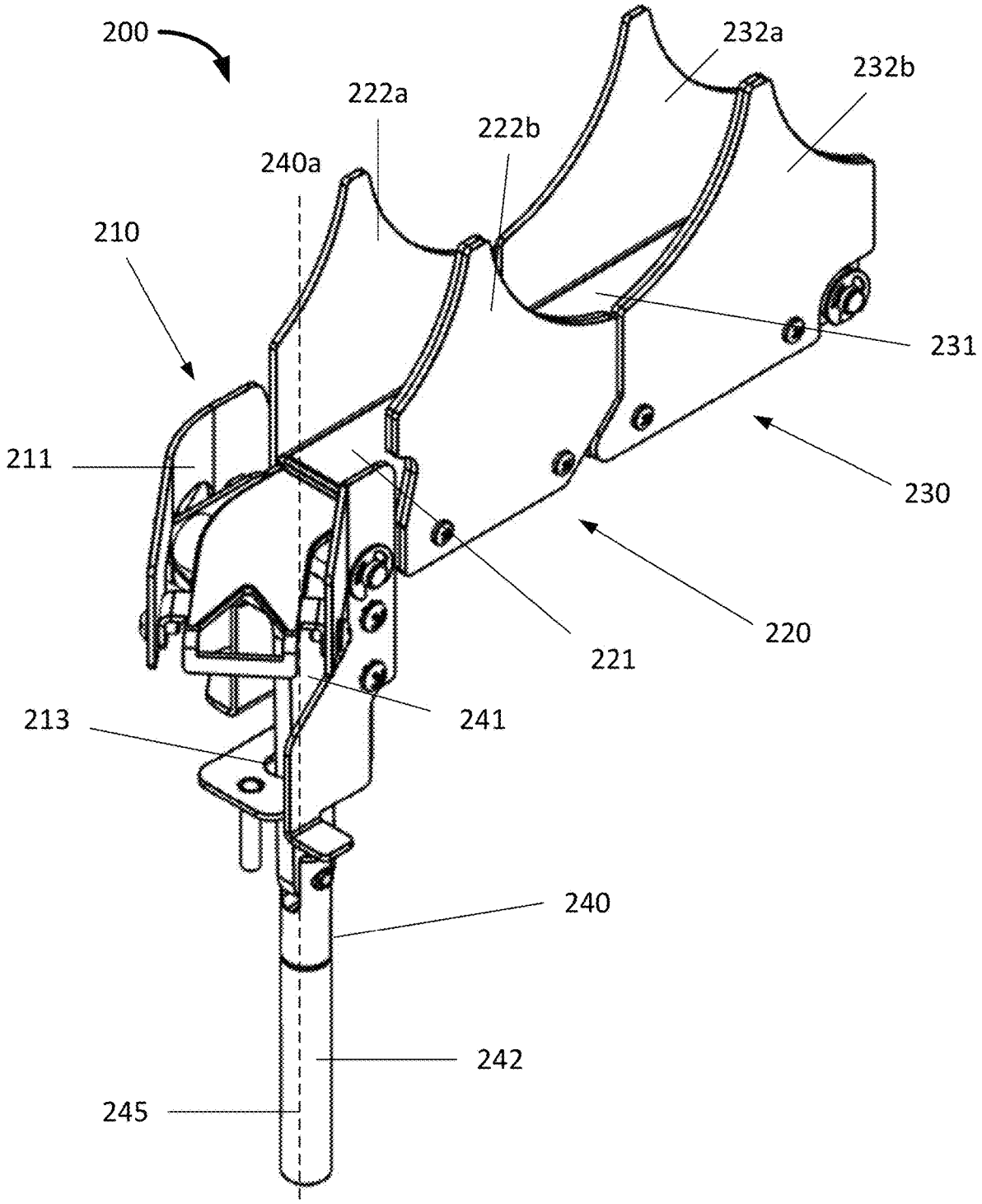
FIG. 4 is a perspective view of an example collapsible ramp.
Figure 5:
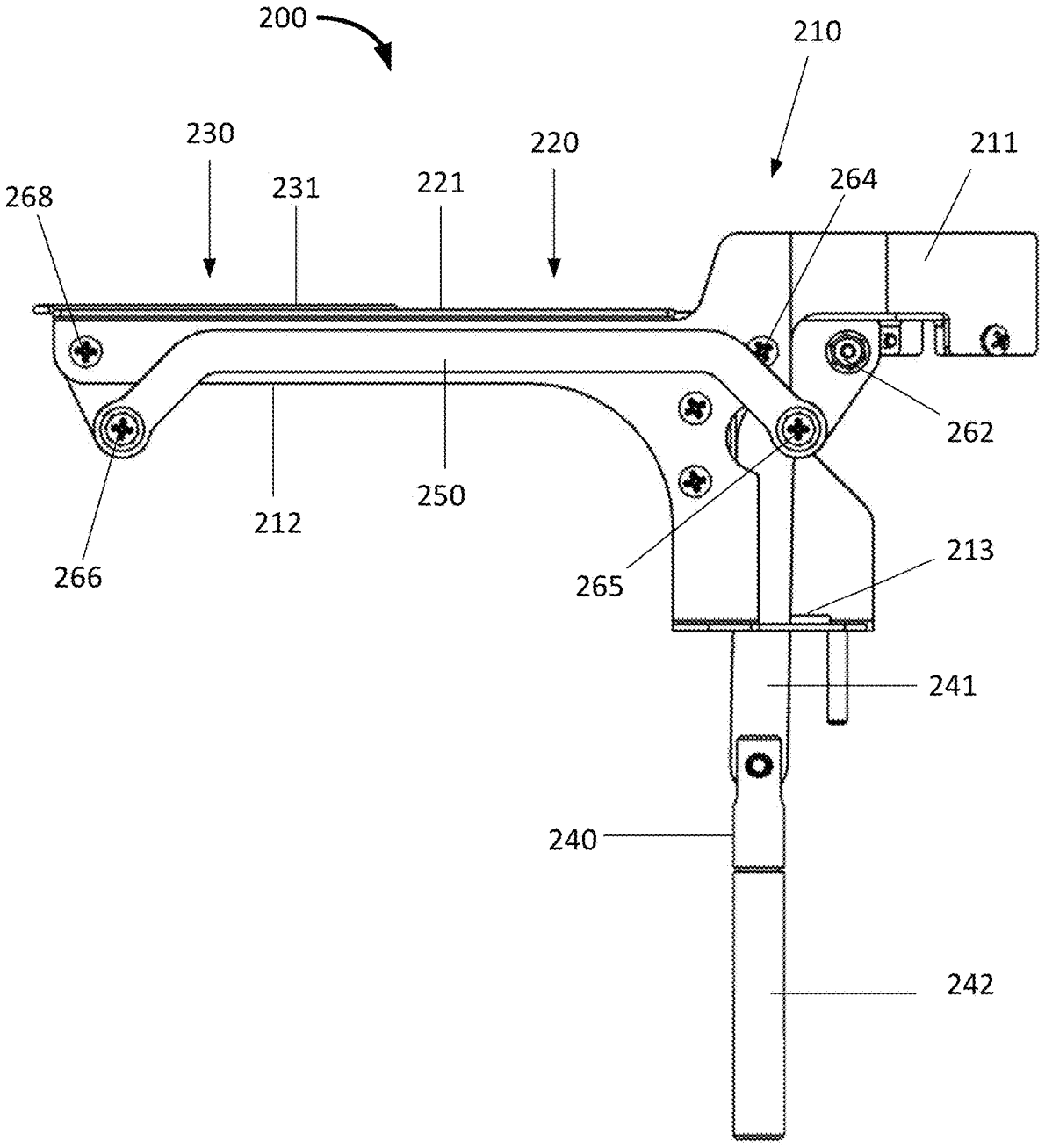
FIG. 5 is a left side view of a portion of the example collapsible ramp where the slidable shaft is in a first position.
Figure 6:
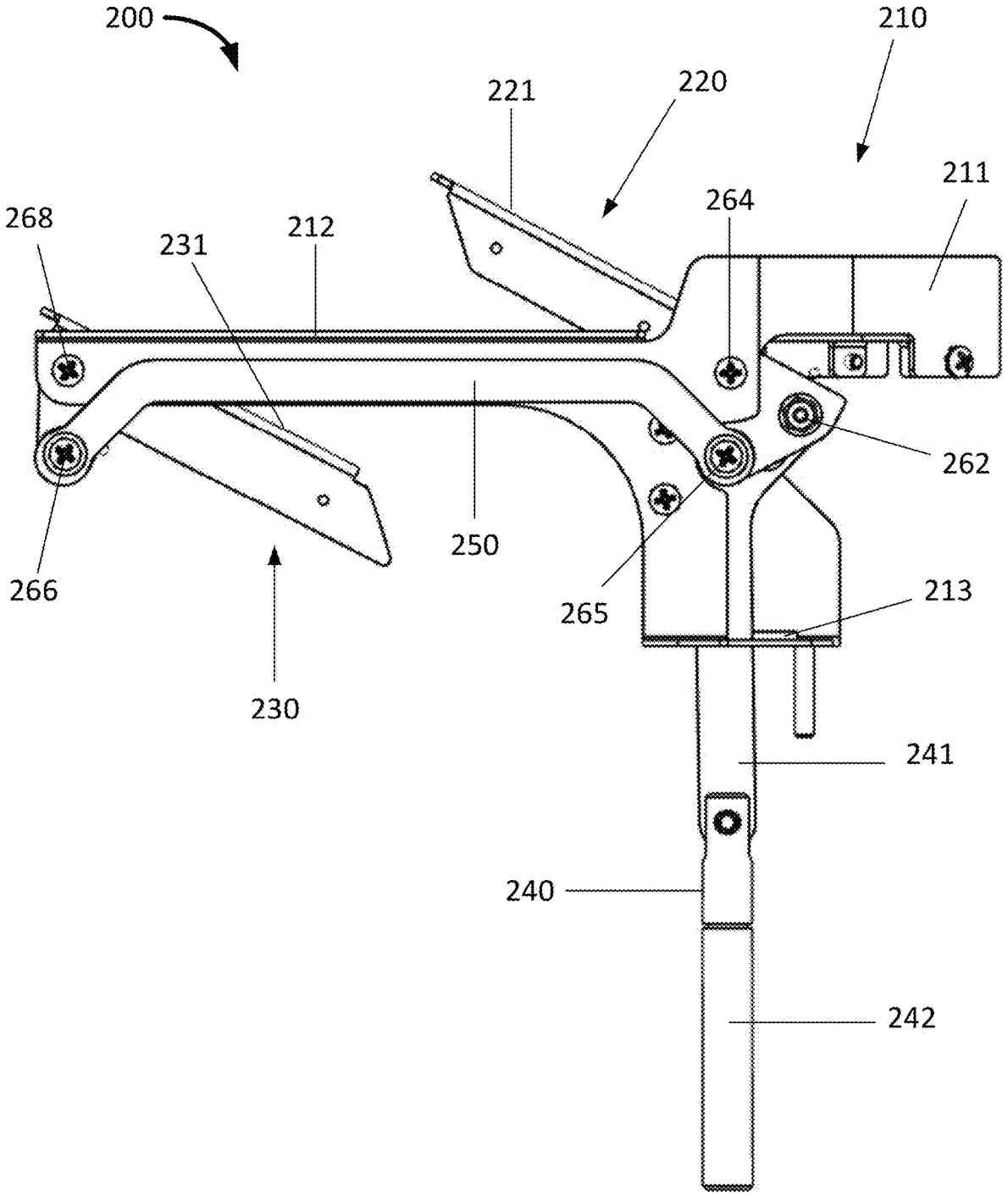
FIG. 6 is a left side view of a portion of the example collapsible ramp in which the slidable shaft is in a second position.
Figure 7:
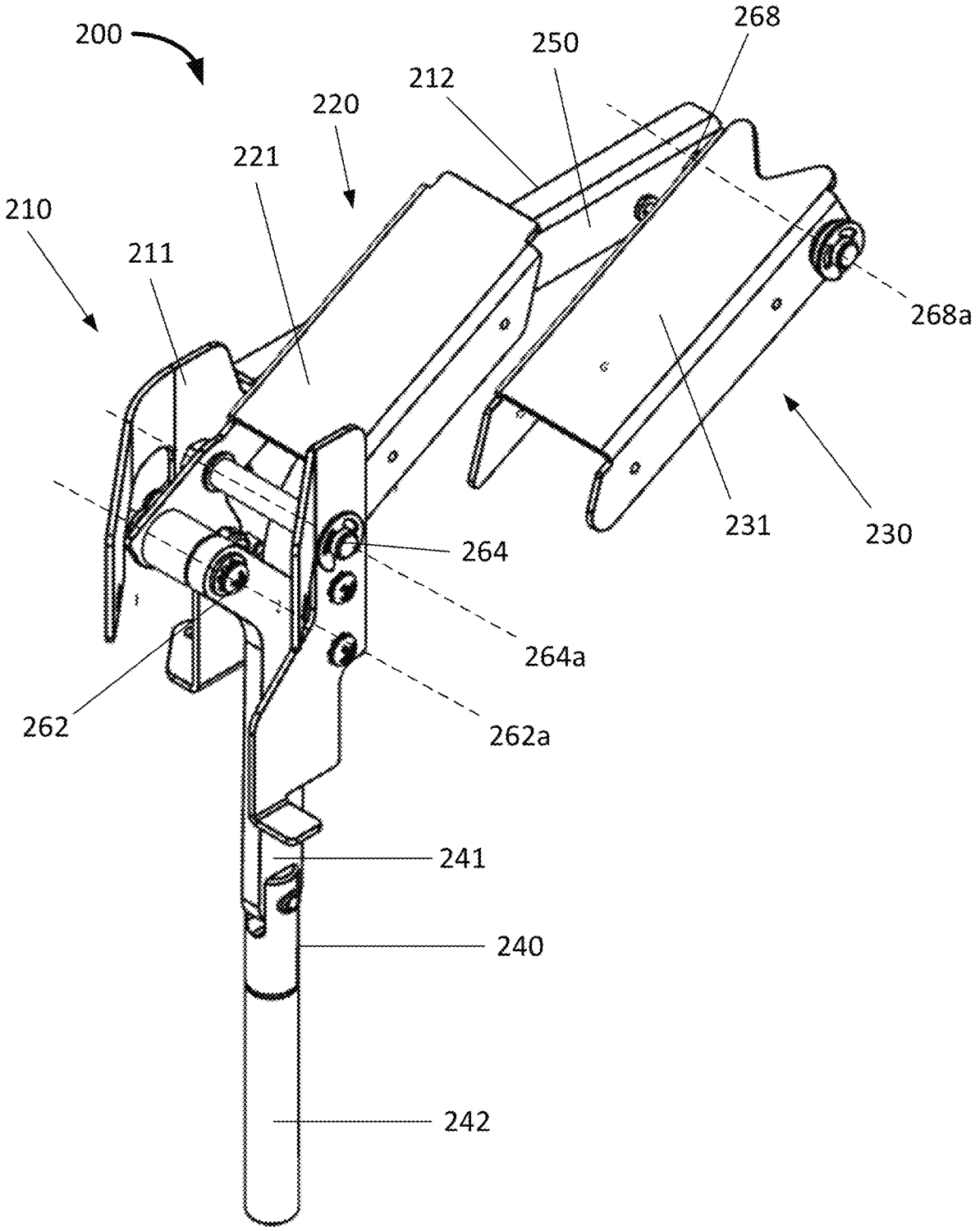
FIG. 7 is a perspective view of a portion of the example collapsible ramp in which the slidable shaft is in the second position.
Figure 8:
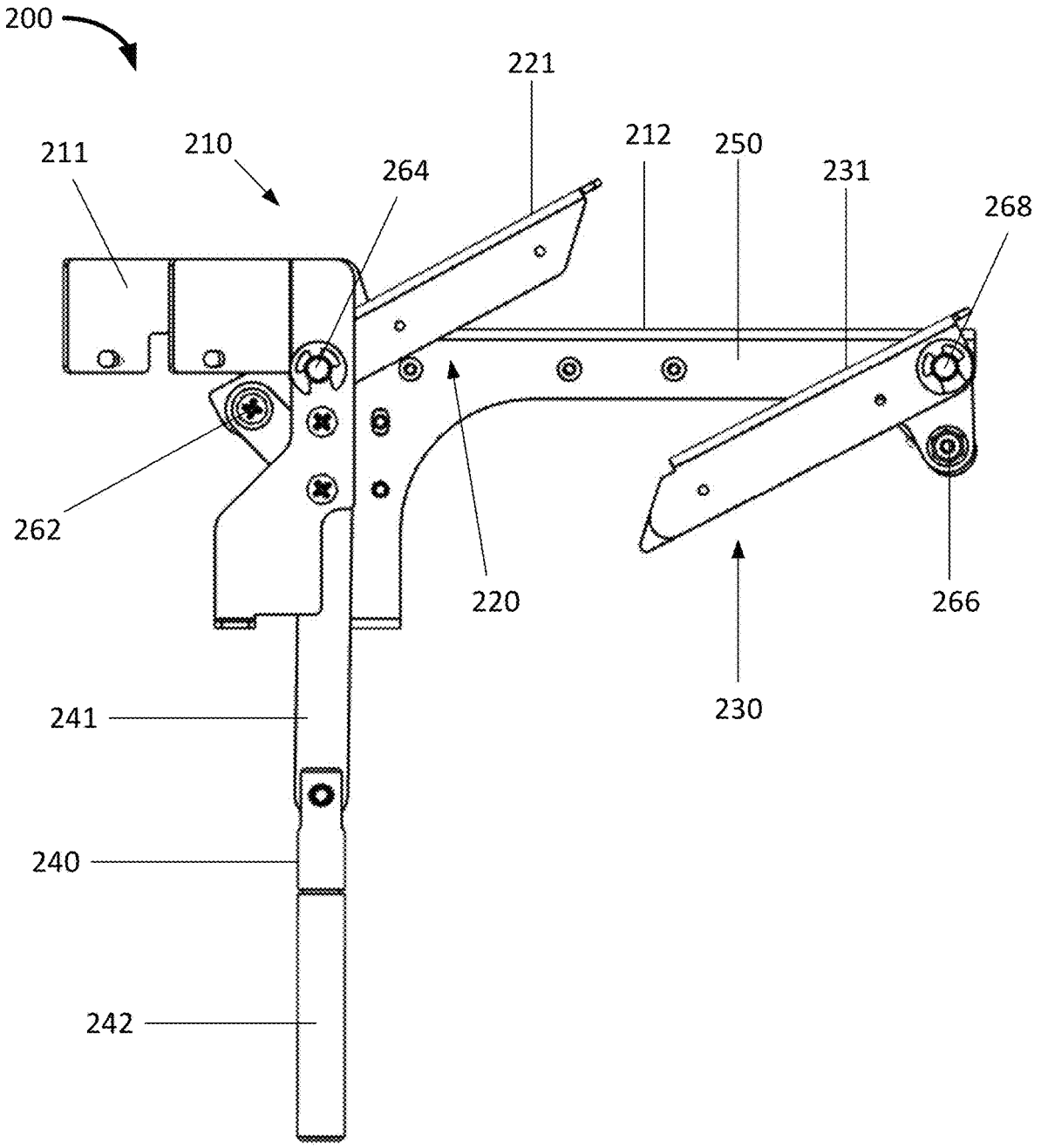
FIG. 8 is a right side view of a portion of the example collapsible ramp in which the slidable shaft is in the second position.
Figure 9:
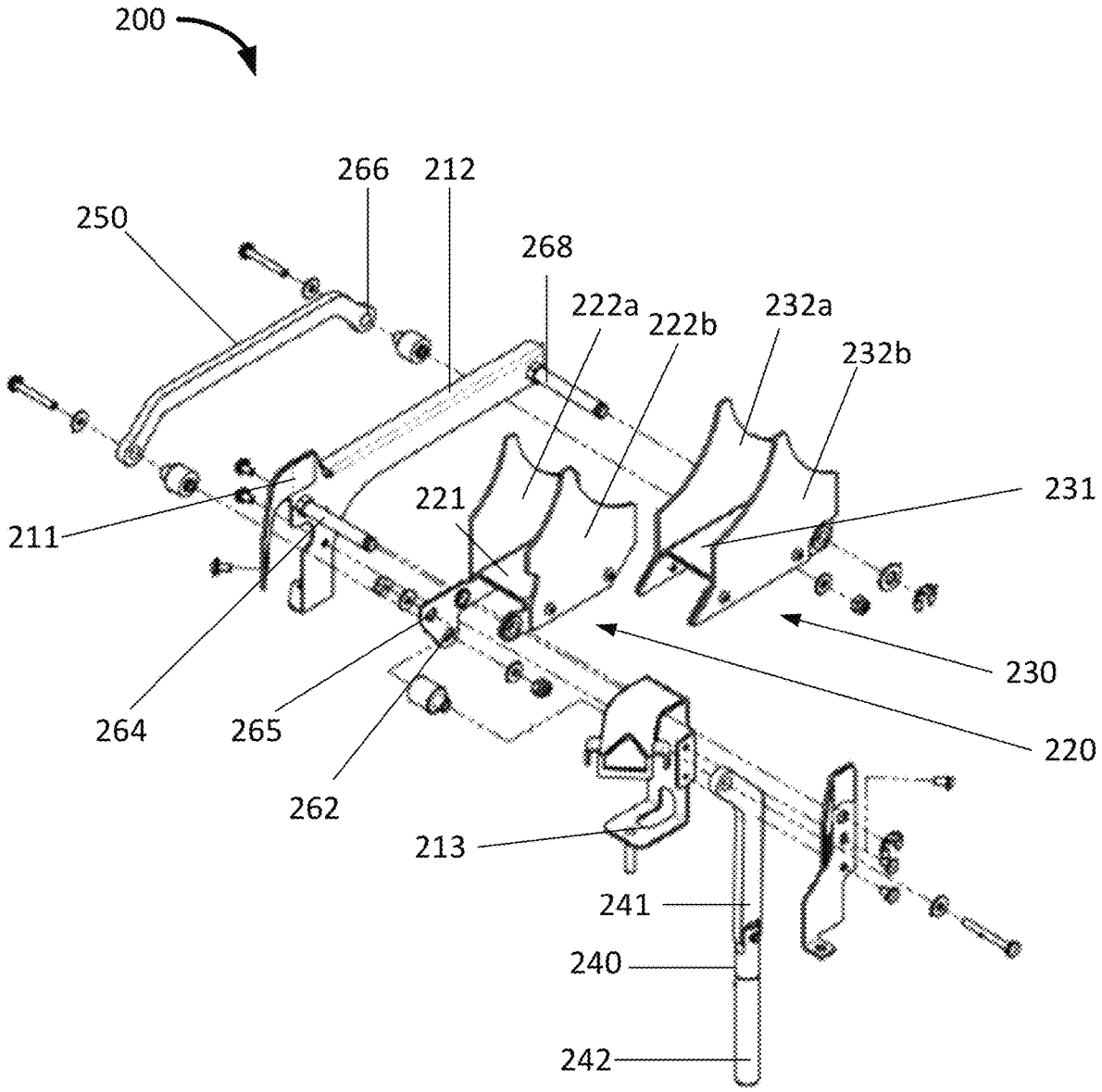
FIG. 9 is an exploded perspective view of the example collapsible ramp.

As shown in FIGS. 4-5, the first ramp surface 221 and the second ramp surface 231 may together define a continuous path for the ball 20 when the slidable shaft 240 is in the first position. As shown in FIGS. 6-8, when the slidable shaft 240 is in the second position, the first ramp surface 221 and the second ramp surface 231 may be discontinuous. The first ramp surface 221 and the second ramp surface 231 may be any suitable material for defining a path for ball 20, such as stainless steel, plastic, or metal. The first ramp portion 220 and the second ramp portion 230 may also include vertically upstanding sidewalls 222*a*, 222*b*, 232*a*, 232*b* coupled to one side of the first ramp surface 221 and the second ramp surface 231 or may include various ramp features such as wires, rails, etc.

The slidable shaft 240 is extendible through an opening formed in the playfield 14 and has a longitudinal axis 240*a* extending through the playfield 14. The slidable shaft 240 extends perpendicular through the playfield 14. The slidable shaft 240 may also include a first shaft portion 241 and a second shaft portion 242. The first shaft portion 241 may be pivotably connected to the second shaft portion 242. The slidable shaft 240 is also coupled to an actuator which may be any suitable actuator, including for example a solenoid mountable below the surface of the playfield 14 as is known in the art. The slidable shaft 240 may be mounted through a suitable fastener such as threaded bolt which is secured to the playfield 14 by a washer and nut. The slidable shaft 240 may also be mechanically coupled to a motor such as a stepper motor (not shown) and as also known in the art. The processing device 42 may also be coupled to the motor such that the motor rotates and moves the slidable shaft 240 between the first position and the second position in response to a command from the motor.

As shown in FIGS. 4-8, the slidable shaft 240 is movable between a first position (shown in FIGS. 4-5) and the second position (shown in FIGS. 6-8) along the longitudinal axis 240*a*. When the slidable shaft 240 is in the second position, the first ramp portion 220 is at a first angle relative to the base 210 and the second ramp portion 230 is at a second angle relative to the base 210. When the slidable shaft 240 is in the second position, the first ramp portion 220 and the second ramp portion 230 are misaligned. The first angle and the second angle may be the same or different.

In operation, the slidable shaft 240 may move between the first position and the second position in response to gameplay switching from a first game mode to a second game mode. For example, the game mode may be switched in response to exceeding a threshold (such as a score, a number of targets hit, the length of time of gameplay, or any other suitable game threshold). The position of the slidable shaft 240 may also be determined through any suitable device that is configured to control gameplay, such as the processing device 42.

Figure 10:
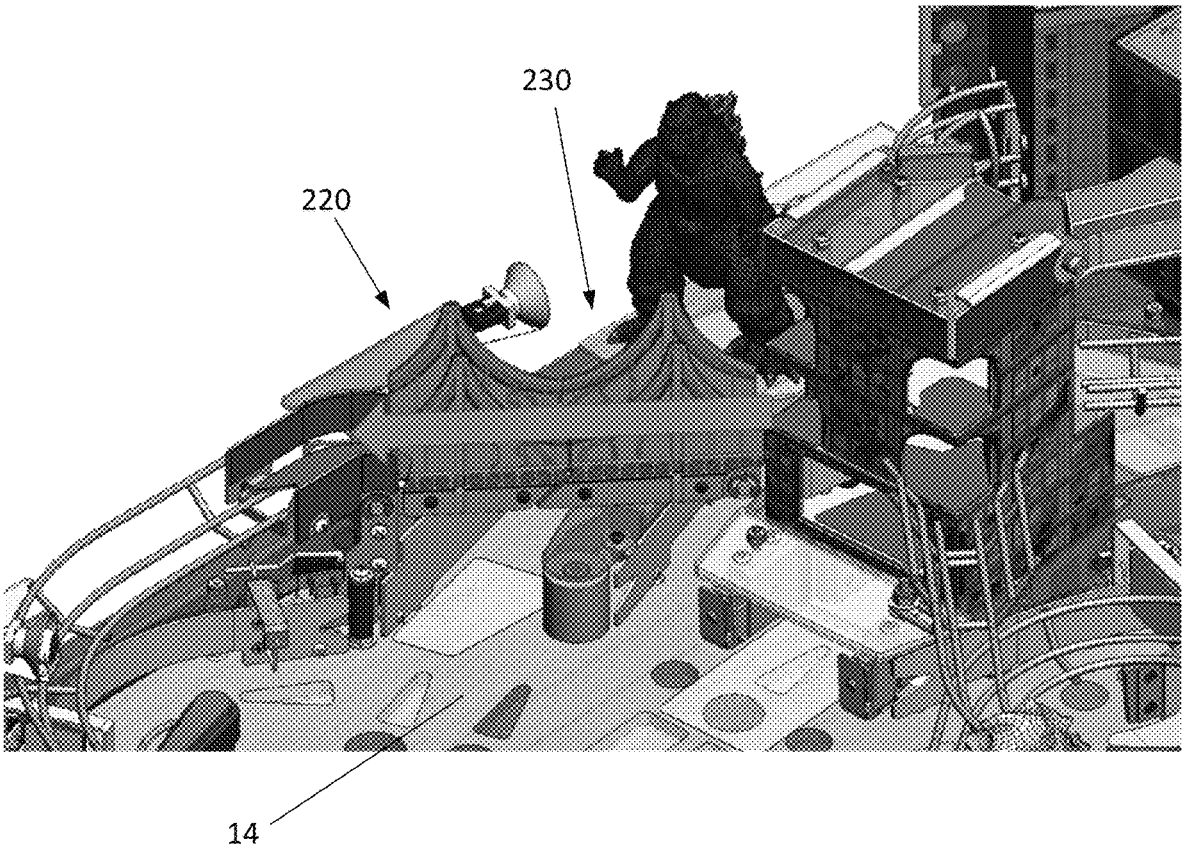
FIG. 10 is a perspective view of the example collapsible ramp in an amusement game device where the slidable shaft is in the first position.
Figure 11:
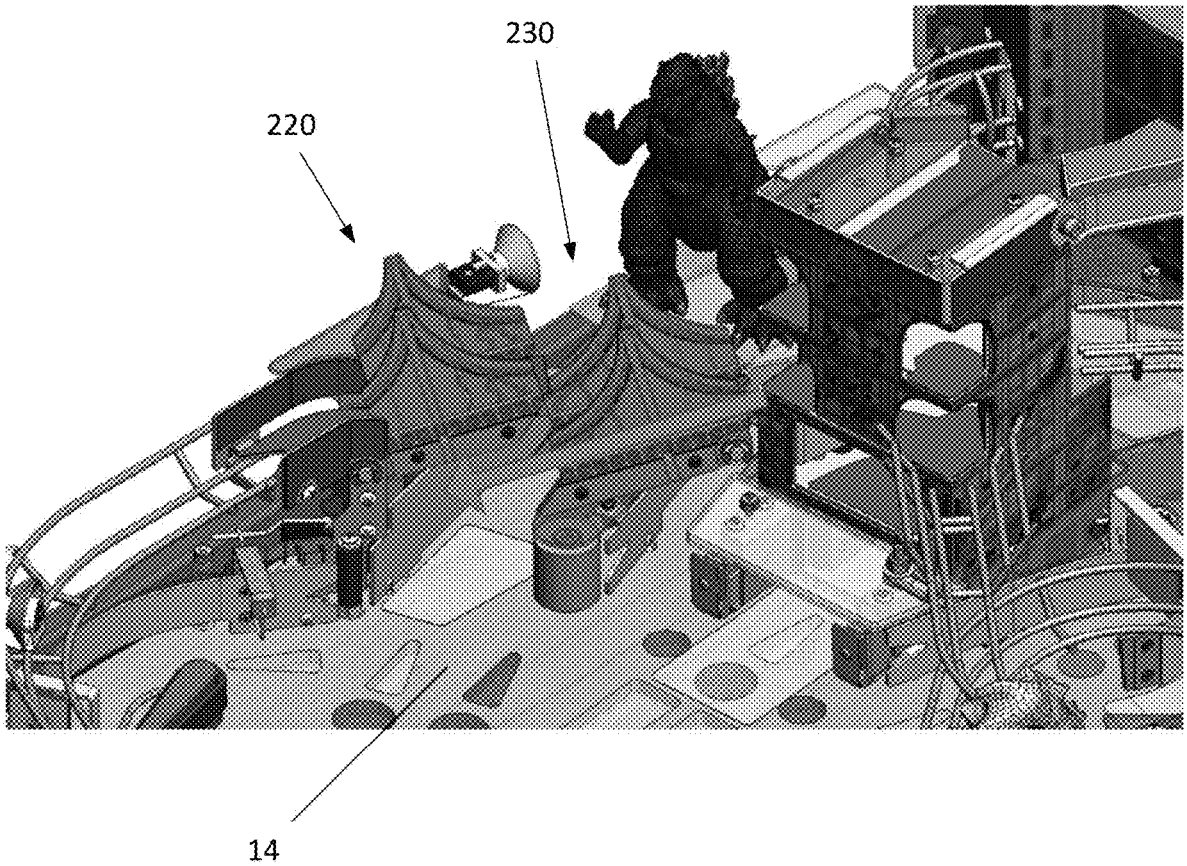
FIG. 11 is a perspective view of an example collapsible ramp in an amusement game device where the slidable shaft is in the second position.

As shown in FIGS. 10-11, the collapsible ramp 200 may be used in an amusement game device and mounted on the playfield 14. In FIG. 10, the slidable shaft 240 is in the first position such that the ball 20 can be diverted back to the player. In FIG. 11, the slidable shaft 240 is in the second position so the first ramp portion 220 and second ramp portion 230 are misaligned and the collapsible ramp 200 appears to be "collapsed" causing the ball 20 to fall off of the collapsible ramp 200.

It will be appreciated that in addition to the operation components of the collapsible ramp 200 as disclosed above, the collapsible ramp 200 may additionally include decorative elements. While the example collapsible ramp 200 is themed as a bridge, it will be appreciated that any number and or variation of gameplay elements may be installed on the sides of the first ramp portion 220 or the second ramp portion 230. For instance, various decorative toys, lighting elements, etc. can be affixed and utilized on the collapsible ramp 200.

While specific examples of the present invention have been disclosed in detail, it will be appreciated by one of ordinary skill in the art that that various modifications and alternatives to those details could be developed in light of the overall teachings of the disclosure. For example, the rotation of the first ramp portion 220 and the second ramp portion 230 may be altered to provide various positions of movement along the rigid link 250 and base 210. Moreover, the slidable shaft 240 itself may be mounted to the playfield 14 such that the longitudinal axis 240*a* does not extend through the playfield 14, but rather, the longitudinal axis 240*a* may be above the playfield 14. In other example modifications, the position of the slidable shaft 240 and the rotation of the first ramp portion 220 and the second ramp portion 230 may be limited, restricted, sensed, or otherwise affected by various known gameplay elements such as drop targets, rollover targets, target switches, posts, pop bumpers, etc.

Although certain example apparatuses have been described herein, the scope of coverage of this patent is not limited thereto. On the contrary, this patent covers all methods, apparatus, and articles of manufacture fairly falling within the scope of the appended claims either literally or under the doctrine of equivalents.

What is claimed is:

1. A collapsible ramp assembly for use with a pinball machine having a playfield and a ball which moves across a surface of the playfield, the collapsible ramp assembly comprising:

a base mountable to the surface of the playfield;

a first ramp portion pivotally coupled to the base and comprising a first ramp surface supported in an elevated arrangement above the playfield;

a second ramp portion pivotally coupled to the base adjacent the first ramp portion and comprising a second ramp surface supported in an elevated arrangement above the playfield;

a slidable shaft pivotally couplable to the first ramp portion and being extendable through an opening formed in the playfield, the slidable shaft having a longitudinal axis extending through the playfield and the slidable shaft being movable between a first position and a second position along the longitudinal axis;

a rigid link pivotally coupled to both the first ramp portion and the second ramp portion; and an actuator coupled to the slidable shaft to move the slidable shaft between the first position and the second position, the first ramp surface and the second ramp surface together defining a continuous path for the ball when the slidable shaft is in the first position, and when the slidable shaft is in the second position, the first ramp surface and second ramp surface are discontinuous.

2. The collapsible ramp assembly according to claim 1, wherein the actuator is a solenoid mountable below the playfield.

3. The collapsible ramp assembly according to claim 1, wherein when the slidable shaft is in the second position, the first ramp portion is at a first angle relative to the base and the second ramp portion is at a second angle relative to the base and the first angle and the second angle are different such that the first ramp surface and the second ramp surface are misaligned.

4. The collapsible ramp assembly according to claim 1, wherein the slidable shaft comprises a first shaft portion pivotably connected to a second shaft portion, the first shaft portion being pivotally coupled to the first ramp portion.

5. The collapsible ramp assembly according to claim 1, wherein the slidable shaft extends perpendicular through the playfield.

6. The collapsible ramp assembly according to claim 1, wherein the base extends in a perpendicular direction relative to the slidable shaft.

7. The collapsible ramp assembly according to claim 1, wherein the first ramp portion is coupled to the slidable shaft at a first pivot point having a first pivot axis and the base is coupled to the first ramp portion at a second pivot point having a second pivot axis.

8. The collapsible ramp assembly according to claim 7, wherein the first pivot axis and the second pivot axis are offset and parallel.

9. The collapsible ramp assembly according to claim 1, further comprising vertically upstanding sidewalls coupled to at least one side of each of the first ramp surface and the second ramp surface.

10. An amusement game, comprising:

a game cabinet supporting a playfield, the playfield mounted within the game cabinet;

a processing device;

a ball which moves across a surface of the playfield; and a collapsible ramp assembly coupled to the processing device and associated with the playfield; the collapsible ramp assembly comprising:

a base mountable to the surface of the playfield;

a first ramp portion pivotally coupled to the base and comprising a first ramp surface supported in an elevated arrangement above the playfield;

a second ramp portion pivotally coupled to the base adjacent the first ramp portion and comprising a second ramp surface supported in an elevated arrangement above the playfield;

a slidable shaft pivotally couplable to the first ramp portion and being extendable through an opening formed in the playfield, the slidable shaft having a longitudinal axis extending through the playfield and the slidable shaft being movable between a first position and a second position along the longitudinal axis;

a rigid link pivotally coupled to both the first ramp portion and the second ramp portion; and an actuator coupled to the slidable shaft to move the slidable shaft between the first position and the second position, the first ramp surface and the second ramp surface together defining a continuous path for the ball when the slidable shaft is in the first position, and when the slidable shaft is in the second position, the first ramp surface and second ramp surface are discontinuous.

11. The amusement game according to claim 10, wherein the actuator is a solenoid mountable below the playfield.

12. The amusement game according to claim 10, wherein when the slidable shaft is in the second position, the first ramp portion is at a first angle relative to the base and the second ramp portion is at a second angle relative to the base and the first angle and the second angle are different such that the first ramp surface and the second ramp surface are misaligned.

13. The amusement game according to claim 10, wherein the slidable shaft comprises a first shaft portion pivotably connected to a second shaft portion, the first shaft portion being pivotally coupled to the first ramp portion.

14. The amusement game according to claim 10, wherein the slidable shaft extends perpendicular through the playfield.

15. The amusement game according to claim 10, wherein the base extends in a perpendicular direction relative to the slidable shaft.

16. The amusement game according to claim 10, wherein the first ramp portion is coupled to the slidable shaft at a first pivot point having a first pivot axis and the base is coupled to the first ramp portion at a second pivot point having a second pivot axis.

17. The amusement game according to claim 16, wherein the first pivot axis and second pivot axis are offset and parallel.

18. The amusement game according to claim 10, further comprising vertically upstanding sidewalls coupled to at least one side of each of the first ramp surface and the second ramp surface.

19. The amusement game according to claim 10, wherein the second ramp portion is coupled to the rigid link at a third pivot point and the base is coupled to the second ramp portion at a fourth pivot point having a fourth pivot axis.

20. The amusement game according to claim 10, wherein the slidable shaft is mechanically coupled to a motor.

* * * * *